US009789022B1

(12) United States Patent
Nam

(10) Patent No.: US 9,789,022 B1
(45) Date of Patent: Oct. 17, 2017

(54) SEQUENTIAL COMPRESSION MASSAGE DEVICE USING STACKED MEMBER

(71) Applicant: DIMEDI Co., Ltd., Wonju-si, Gangwon-do (KR)

(72) Inventor: Youn Nam, Yongin-si (KR)

(73) Assignee: DIMEDI CO., LTD., Wonju-si, Gangwon-do (KR)

( * ) Notice: Subject to any disclaimer, the term of this patent is extended or adjusted under 35 U.S.C. 154(b) by 0 days.

(21) Appl. No.: 15/393,639

(22) Filed: Dec. 29, 2016

(30) Foreign Application Priority Data

Jul. 20, 2016 (KR) ..... 10-2016-0092194

(51) Int. Cl.
*A61H 11/00* (2006.01)
*A61H 1/00* (2006.01)

(52) U.S. Cl.
CPC ..... *A61H 1/008* (2013.01); *A61H 11/00* (2013.01); *A61H 2201/12* (2013.01); *A61H 2201/5061* (2013.01); *A61H 2205/106* (2013.01); *A61H 2209/00* (2013.01)

(58) Field of Classification Search
CPC ..... A61H 7/001; A61H 2015/0028; A61H 2015/0035; A61H 23/00; A61H 23/006; A61H 23/02; A61H 23/0254; A61H 2023/002; A61H 2023/0209; A61H 11/00; A61H 11/02; A61H 2011/005
See application file for complete search history.

(56) References Cited

U.S. PATENT DOCUMENTS 4,202,326 A * 5/1980 Van Gerpen ..... A61H 23/0254 601/103
5,092,315 A * 3/1992 Bennett ..... A61H 1/00 601/101
9,549,867 B1 * 1/2017 El-Messeiry ..... A61H 7/001
2004/0260216 A1 * 12/2004 Zicherman ..... A61H 23/0254 601/111
2007/0069730 A1 * 3/2007 Kimmlingen ..... G01R 33/3804 324/318
2007/0083134 A1 * 4/2007 Ganti ..... A61H 23/006 601/90
2007/0179336 A1 * 8/2007 Knyrim ..... A61H 19/44 600/38

(Continued)

FOREIGN PATENT DOCUMENTS

KR 10-1139538 B1 5/2012
KR 10-1572974 B1 12/2015

*Primary Examiner* — Michael Tsai
(74) *Attorney, Agent, or Firm* — Rabin & Berdo, P.C.

(57) ABSTRACT

Disclosed is a sequential compression massage device using a stacked member which repeatedly applies compression force to a human body (10). The message includes: a driving unit for rotatably supporting a shake rod on an upper plate and a lower plate connected to each other through a guide rod; a pressing unit for maintaining a plurality of pressing plates in a stacked state on the driving unit by positioning the guide rod and the shake rod (34) in the pressing plates; and a control unit for sequentially shaking the pressing plates. Thus, the reliability and durability are improved in such a manner that the plurality of stacked pressing plates cause shake movement without causing a user inconvenience, thereby enhancing the effectiveness of the prevention and alleviation of venous circulation disorder.

6 Claims, 4 Drawing Sheets

(56) References Cited

U.S. PATENT DOCUMENTS

| | | | | |
|---|---|---|---|---|
| 2009/0198158 | A1* | 8/2009 | Nan | A61H 15/0085<br>601/87 |
| 2010/0152631 | A1* | 6/2010 | Knyrim | A61H 23/0254<br>601/89 |

* cited by examiner

SEQUENTIAL COMPRESSION MASSAGE DEVICE USING STACKED MEMBER

BACKGROUND OF THE INVENTION

1. Field of the Invention

The present invention relates to a massage device, and more particular, to a sequential compression massage device using stacked member, which is capable of improving blood circulation by pressing the leg calf of a user similarly with that of an actual massage.

2. Description of the Related Art

The leg calf of a human body is an important muscular system enough to be called the second heart. When the leg calf is periodically massaged, it is an effect on fatigue recovery and immunity improvement. In addition, the massage of the leg calf may enhance connective tissue of venous wall to improve vein circulation disability that causes undercurrents or retention of blood and body fluid flowing into a heart. As a nonsurgical method for preventing or releasing such symptoms, exercise and compression circulation massage are preferred.

Documents of the related art about calf massage have been disclosed in Korean Patent Registration No. 10-1139538 (document 1) and Korean Patent Registration No. 10-1572974 (document 2).

Document 1 discloses a portable compression cuff which is wearable on a calf for prevention of low leg varicose vein and rehabilitation, where the cuff includes at least two air pressure rooms embedded therein and expanded or contracted by air to sequentially press the calf level by level. The air pressure chamber includes pressing parts spaced apart from each other. Thus, the portable compression cuff prevents blood from flowing backward and helps blood circulation to promote prevention of low leg varicose vein and rehabilitation.

However, since the portable compression cuff employs an air pump, the volume is enlarged so that it is inconvenient to carry the portable compression cuff while the portable compression cuff is worn. In addition, since noise is generated due to the input and output of air, it is improper to wear portable compression cuff at a public place.

Document 2 discloses a compression massage device which includes a wearing unit having a wearing band and pressing bands and tightly attached to a human being; a driving unit connected to a side of the wearing unit to stretch and release the pressing bands; and a control unit for controlling the pressure bands through the driving unit, respectively. Thus, a user may receive a massage in activity based on the compact and low-noise structure, thereby enhancing the effectiveness of the prevention and alleviation of the venous circulation disorder.

However, since the pressure transferred to the pressing bands through a rotational shaft is not constant and there is apprehension that the pressing bands are released, the compression massage device may have room for improvement.

SUMMARY OF THE INVENTION

The present invention has been made to solve the above problems occurring in the related art. An object of the present invention is to provide a sequential compression massage device using stacked member, which is capable of improving blood circulation by pressing the leg calf of a user similarly with that of an actual massage based on components having reliability and durability, so that the prevention or alleviation of the venous circulation disorder may be expected.

In order to achieve the above object, according to the present invention, there is provided a sequential compression massage device using a stacked member, which repeatedly applies compression force to a human body (10). The sequential compression massage device includes: a driving unit (30) for rotatably supporting a shake rod (35) on an upper plate (31) and a lower plate (32) connected to each other through a guide rod (34); a pressing unit (40) for maintaining a plurality of pressing plates (41) in a stacked state on the driving unit (30) by positioning the guide rod (34) and the shake rod (34) in the pressing plates (41); and a control unit (50) for sequentially shaking the pressing plates (41).

The driving unit (30) is integrally coupled with a wearing band (20) having a tightening part (25) and the tightening part (25) has an adjustable length.

The shake rod (35) of the driving unit (30) is formed in at least one of a wave-shaped curved line having a planar shape and a spiral-shaped curved line.

The pressing plate (41) of the pressing unit (40) includes an arch surface (42) which has a curved shape and makes contact with the human body (10).

The pressing plate (41) of the pressing unit (40) comprises a longitudinal groove (44) for determining a shake movement direction and a traversal groove (45) for receiving rotational movement of the shake rod (35) to cause shake movement.

The pressing plate (41) of the pressing unit (40) includes a Teflon resin layer provided on a contact surface between stacked pressing plates (41), a longitudinal groove (44) and a traversal groove (45).

The control unit (50) includes a sensing part (52) for detecting a variation in pressing force, a power source part (54) for providing operation power, and a control part (56) for storing and executing a set algorithm.

According to the massage device of the present invention, the reliability and durability are improved in such a manner that the plurality of stacked pressing plates cause shake movement without causing a user inconvenience, thereby enhancing the effectiveness of the prevention and alleviation of venous circulation disorder.

DETAILED DESCRIPTION OF THE INVENTION

Figure 1:
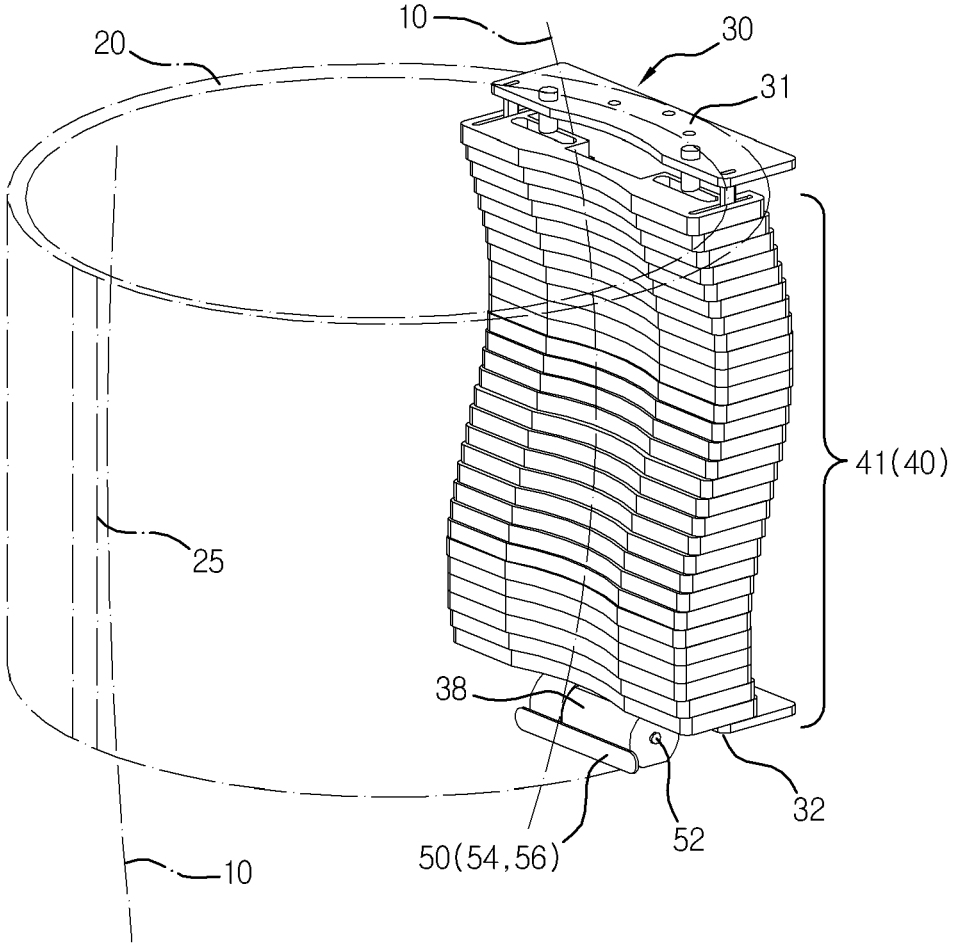
FIG. 1 is a front perspective view showing a massage device according to an embodiment of the present invention.
Figure 2:
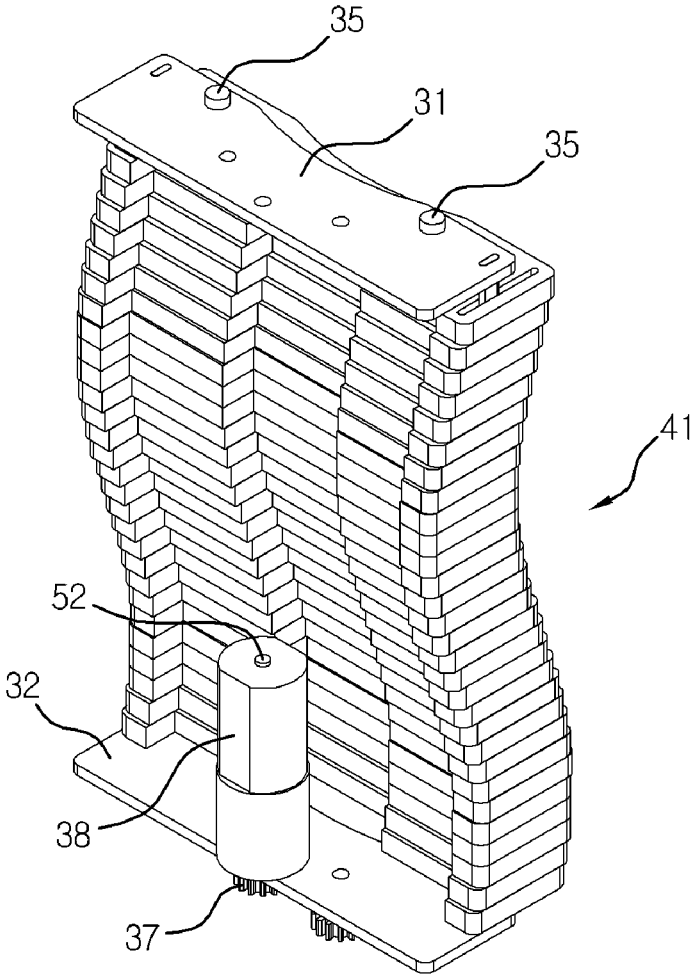
FIG. 2 is a rear perspective view showing a massage device according to an embodiment of the present invention.

Hereinafter, an embodiment of the present invention will be described in detail with reference to the accompanying drawings.

The present invention proposes a massage device for repeatedly applying pressing force to a human body (10). Although the calf is targeted as the human body 10 in the present disclosure in order to explain vein circulation disability, specifically, deep vein thrombosis (DVT) of a lower leg around the calf, the present invention is not limited thereto. The massage device according to the present invention seeks for the convenience in use on daily life or during the travel due to the portability thereof.

As the details of the present invention, a driving unit 30 is integrally coupled with a wearing band 20 having a tightening part (25), and the tightening part (25) has an adjustable length. The wearing band 20 is formed of a material having some elasticity. As will be described below, a driving unit 30, a pressing unit 40 and a control unit 50 are mounted on the wearing band 20. A tightening part 25 is formed by selectively using a Velcro belt, a zipper, a button and the like. It is preferable to form the wearing band 20 in a multi-divided structure to allow the wearing band 20 to be easily adjustable to a shape or size of a human body.

According to the present invention, the driving unit 30 is structured to rotatably support a shake rod 35 on an upper plate 31 and a lower plate 32 connected to a guide rod 34. The driving unit 30, which constitutes the frame of the massage device, firmly fixes the upper and lower plates 31 and 32 with the guide rod 34. The upper and lower plates 31 and 32, which are formed of a high-strength lightweight plate, each has a front curved surface for making contact with a human body. Although a pair of left and right guide rods 34 is depicted in the drawings, two pairs of guide rods 34 may be provided for left and right sides, respectively. A pair of left and right shake rods 35 is provided inside the guide rod 34 and rotatably supported on the upper and lower plates 31 and 32.

In this case, a gear train 37 provided on a lower end of the shake rod is connected to a motor 38 on the lower plate 32. The gear train 37 is configured to transfer rotational force of the motor 38 to the shake rods 35 of both sides at the same time.

As the details of the present invention, the shake rod 35 of the driving unit 30 is formed in at least one of a wave-shaped curved line having a planar shape and a spiral-shaped curved line. The wave-shaped curved line having a planar shape implies a sinusoidal wave or a non-sinusoidal wave having various amplitudes and periods, and the spiral-shaped curved line implies a three-dimensional shape such as a shape of a spiral spring having a narrow amplitude and a short period. Of course, the shake rod 35 may be configured to have the combination of the wave-shaped curved line and the spiral-shaped curved line. Since the shake rod 35 is operated to press a human body, although the shake rod 35 is required to have a basic strength and stiffness, the shake rod 35 may be elastically deformed suitable for soft massage.

In addition, according to the present invention, the pressing unit 40 is structured to be maintained in a stacked state on the driving unit 30 by positioning the guide rod 34 and the shake rod 35 in the pressing plates 41. The pressing unit 40, which is an operating part coupled to a frame of the massage device, is a key element of implementing a sequential compression device (SCD) by stacking the same or similar pressing plates thereon. Although it may be no matter that the pressing plate 41 has strength less than the upper and lower plates 31 and 32, lightweightness and durability are required.

Figure 3:
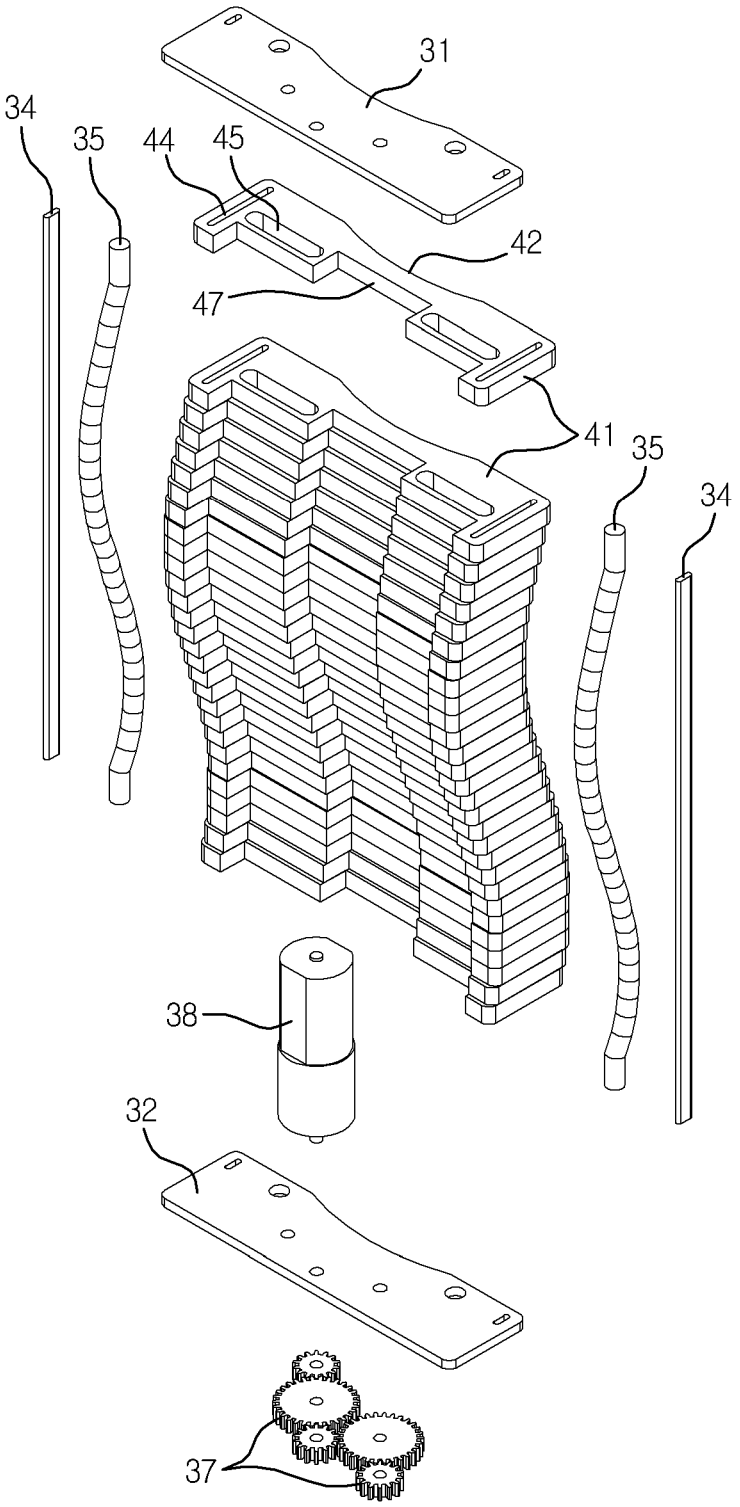
FIG. 3 is an exploded perspective view showing a massage device according to an embodiment of the present invention

As the details of the present invention, the pressing plate 41 of the pressing unit 40 includes an arch surface 42 which has a curved shape and makes contact with the human body 10. FIG. 3 exemplarily shows the pressing plate 41 which has the arch surface 42 concaved at the center of the front surface thereof like the upper and lower plates 31 and 32. Preferably, the arch surface 42 of the stacked pressing plates 41 has a variable curvature such that the arch surface 42 is changed little by little to substantially correspond to the curved shape of a human body, for example, a calf.

As the details of the present invention, the pressing plate 41 of the pressing unit 40 includes a longitudinal groove 44 for determining a shake movement direction and a traversal groove 45 for receiving rotational movement of the shake rod 35 to cause shake movement. The longitudinal groove 44 is formed in front and rear of the pressing plate 41 and the traversal groove 45 is formed in a direction orthogonal with an inside of the longitudinal groove 44. The guide rod 34 passes through the longitudinal groove 44 of the stacked pressing plates 41 and the shake rod 35 passes through the traversal groove 45 of the stacked pressing plates 41. The longitudinal and traversal grooves 44 and 45 are not necessarily limited to the straight-line shape. The longitudinal and traversal grooves 44 and 45 may be formed in a curved-line shape with a partial clearance fit tolerance such that the longitudinal and traversal grooves 44 and 45 may not restrict the shaking movements of the pressing plates 41.

When the driving power of the motor 38 is transferred to the shake rod 35, the stacked pressing plates 41 sequentially do the shaking movement substantially in forward and rearward directions determined by the longitudinal groove 44 at the amplitude and period determined by the traversal groove 45.

Meanwhile, the pressing plate 41 may have an additional groove to reduce the weight in such a range that the strength is not weakened. A cutting surface 47 shown in FIG. 3 provides a space for containing the motor 38 as well as for weight lightening.

As a modified example of the present invention, the pressing plate 41 of the pressing unit 40 includes a Teflon resin layer provided on a contact surface between stacked pressing plates 41, a longitudinal groove 44 and a traversal groove 45. If the pressing plate 41 is made of an expensive wear-resistance material such as engineering plastic, the manufacturing cost is increased, so it is preferable to coat common plastic with Teflon resin. As the Teflon resin is applied to the pressing plates 41, the pressing plates 41 have variable thickness so that the sliding contact can be reduced over the whole area of the pressing plates 41. The Teflon resin layer is provided in areas where the guide and shake rods 34 and 35 make sliding contact in the longitudinal and traversal grooves 44 and 45.

Of course, the present invention is not limited to the Teflon resin layer of the pressing plate 41. The pressing plate 41 may be integrated with a separated wear-resistance material in an inserting molding scheme.

In addition, according to the present invention, the control unit 50 is structured to sequentially shake the pressing plate 41. The control unit 50 is an element that drives the driving unit 30 in a set algorithm to perform a massage for improving vein circulation disability. Of course, as well as the set algorithm, a massage function desired by a user may be performed through manual selection.

As a modified example of the present invention, the control unit 50 includes a sensing part 52 for detecting a variation in pressing force, a power source part 54 for providing operation power, and a control part 56 for storing and executing a set algorithm. The sensing part 52, which detects an overload, selectively uses a current sensor installed to the motor 38 or a rotation sensor. The power source part 54 is based on a chargeable battery and further has a function of using commercial power. The control part 56 is a microcomputer circuit including a microprocessor, a memory and an I/O interface and an operational panel attached to the wearing band 20 or a remote controller is selectively used.

Figure 4:
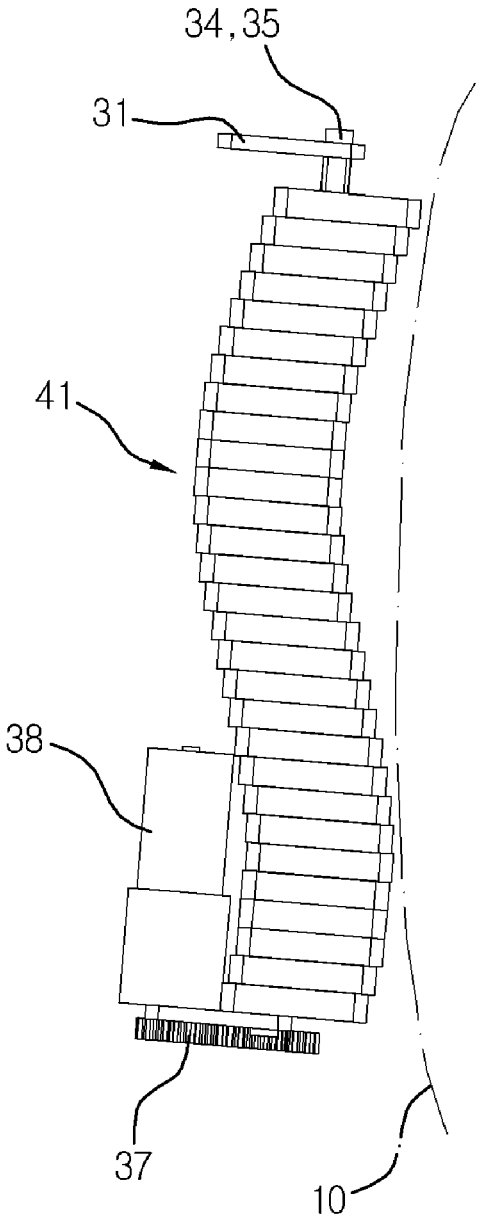
FIG. 4 is a view showing main components of a massage device according to an embodiment of the present invention.

As one example of an operation, FIG. 4 shows a state that the pressing plate 41 applies pressing force through a spaced portion between the upper portion and lower portions of a human being 10. As the motor 38 is rotated, a pressing point is sequentially changed such that the massage is performed at a set period. Although a user may usually increase or reduce pressing feeling by releasing or tightening the tightening part 25 of the wearing band 20, the control part 56 changes the speed of the motor 38 or stops driving the motor 38 in response to an input of the sensing part 52.

The present invention is not limited to the embodiment described herein and it should be understood that the present invention may be modified and changed in various ways without departing from the spirit and the scope of the present invention. Therefore, it should be appreciated that the modifications and changes are included in the claims of the present invention.

What is claimed is:

1. A sequential compression massage device comprising:

a driving unit (30) for rotatably supporting a shake rod (35) on an upper plate (31) and a lower plate (32) connected to each other through a guide rod (34);

a pressing unit (40) for maintaining a plurality of pressing plates (41) in a stacked state on the driving unit (30) by positioning the guide rod (34) and the shake rod (35) in the pressing plates (41), wherein the plurality of pressing plates are driven by the shake rod (35) to repeatedly apply sequential compression force to a human body; and a control unit (50) for sequentially shaking the pressing plates (41) wherein the driving unit (30) is integrally coupled with a wearing band (20) having a tightening part (25), and the tightening part (25) has an adjustable length.

2. The sequential compression massage device of claim 1, wherein the shake rod (35) of the driving unit (30) is formed in at least one of a wave-shaped curved line having a planar shape and a spiral-shaped curved line.

3. The sequential compression massage device of claim 1, wherein the pressing plate (41) of the pressing unit (40) comprises an arch surface (42) which has a curved shape and makes contact with the human body (10).

4. The sequential compression massage device of claim 1, wherein the pressing plate (41) of the pressing unit (40) comprises a longitudinal groove (44) for determining a shake movement direction and a traversal groove (45) for receiving rotational movement of the shake rod (35) to cause shake movement.

5. The sequential compression massage device of claim 1, wherein the pressing plate (41) of the pressing unit (40) comprises a Teflon resin layer provided on a contact surface between stacked pressing plates (41), a longitudinal groove (44) and a traversal groove (45).

6. The sequential compression massage device of claim 1, wherein the control unit (50) comprises a sensing part (52) for detecting a variation in pressing force, a power source part (54) for providing operation power, and a control part (56) for storing and executing a set algorithm.

* * * * *